US006524135B1

(12) United States Patent
Feldman et al.

(10) Patent No.: US 6,524,135 B1
(45) Date of Patent: Feb. 25, 2003

(54) CONTROLLED IMPEDANCE CABLE CONNECTOR

(75) Inventors: Steven Feldman, Cedar Park, TX (US); Wing C. Chow, Austin, TX (US); Richard J. Scherer, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/400,519

(22) Filed: Sep. 20, 1999

(51) Int. Cl.[7] ..... H01R 9/03

(52) U.S. Cl. ..... 439/610; 439/701

(58) Field of Search ..... 439/603, 610, 439/608, 578, 609, 579, 109, 95, 108, 687, 696, 906, 701

(56) References Cited

U.S. PATENT DOCUMENTS

| | | | | | |
|---|---|---|---|---|---|
| 3,993,394 | A | | 11/1976 | Cooper | 339/136 |
| 4,099,323 | A | | 7/1978 | Bouvier | 29/629 |
| 4,449,778 | A | * | 5/1984 | Lane | 439/610 |
| 4,705,332 | A | | 11/1987 | Sadigh-Behzadi | 439/69 |
| 4,720,155 | A | | 1/1988 | Schildkraut et al. | 439/108 |
| 4,735,583 | A | * | 4/1988 | Rudy, Jr. et al. | 439/350 |
| 4,767,345 | A | * | 8/1988 | Gutter et al. | 439/92 |
| 4,850,898 | A | | 7/1989 | Gallusser | 439/595 |
| 5,090,911 | A | | 2/1992 | Welsh | 439/79 |
| 5,171,161 | A | * | 12/1992 | Kachlic | 439/352 |
| 5,184,965 | A | | 2/1993 | Myschik et al. | 439/578 |
| 5,244,415 | A | * | 9/1993 | Marsilio et al. | 439/610 |
| 5,279,415 | A | | 1/1994 | Edgley et al. | 206/328 |
| 5,380,216 | A | | 1/1995 | Broeksteeg et al. | 439/352 |
| 5,380,223 | A | * | 1/1995 | Marsh et al. | 439/610 |
| 5,441,424 | A | | 8/1995 | Morlion et al. | 439/581 |
| 5,460,533 | A | | 10/1995 | Broeksteeg et al. | 439/101 |
| 5,477,159 | A | | 12/1995 | Hamling | 324/754 |
| 5,507,653 | A | | 4/1996 | Stoner | 439/74 |
| 5,511,992 | A | | 4/1996 | Thalhammer | 439/609 |
| 5,518,421 | A | * | 5/1996 | Davis | 439/607 |
| 5,524,766 | A | | 6/1996 | Marchek et al. | 206/718 |
| 5,600,544 | A | | 2/1997 | Thalhammer | 361/816 |
| 5,632,634 | A | | 5/1997 | Soes | 439/101 |
| 5,702,258 | A | | 12/1997 | Provencher et al. | 439/79 |
| 5,743,765 | A | | 4/1998 | Andrews et al. | 439/608 |
| 5,766,036 | A | | 6/1998 | Ahmad et al. | 439/578 |
| 5,775,924 | A | | 7/1998 | Miskin et al. | 439/98 |
| 5,934,942 | A | * | 8/1999 | Patel et al. | 439/610 |
| 5,938,476 | A | * | 8/1999 | Wu et al. | 439/610 |
| 5,941,733 | A | * | 8/1999 | Lai | 439/610 |
| 6,007,385 | A | * | 12/1999 | Wu | 439/610 |
| 6,039,606 | A | * | 3/2000 | Chiou | 439/610 |
| 6,089,916 | A | * | 7/2000 | Kuo | 439/610 |

FOREIGN PATENT DOCUMENTS

| | | | |
|---|---|---|---|
| EP | 0 284 245 A1 | 9/1988 | H01R/0/05 |
| EP | 0 548 942 A1 | 6/1993 | |
| EP | 0 654 859 A1 | 5/1995 | H01R/13/514 |
| EP | 0 696 085 A2 | 2/1996 | H01R/13/514 |
| EP | 0 907 221 A2 | 4/1999 | H01R/13/58 |
| EP | 0 446 980 B2 | 5/1999 | H01R/23/68 |
| JP | 01 023947 | 1/1989 | |

OTHER PUBLICATIONS

Search Report for PCT/US00/02553.

* cited by examiner

*Primary Examiner*—Tho D. Ta
*Assistant Examiner*—Edwin A. León
(74) *Attorney, Agent, or Firm*—Yen Tong Florczak

(57) ABSTRACT

An electrical connector for terminating a shielded cable and connecting the cable to regularly arranged contact pins. The connector includes a connector body formed from an insulative material. The connector body has an upper surface and an opposing lower surface defined by a front edge, a back edge and two longitudinal side edges. The upper surface includes a plurality of longitudinal channels adapted to receive a plurality of socket contacts. A planar conductive ground plate engages the bottom surface of the connector body and extends across each of the plurality of socket contacts to establish a ground plane across the entire connector. A cover member encloses the longitudinal channels and socket contacts. A plurality of individual connectors may be stacked together and retained in a stack by a removable retaining rod.

25 Claims, 14 Drawing Sheets

CONTROLLED IMPEDANCE CABLE CONNECTOR

BACKGROUND OF THE INVENTION

The present invention relates to a connector for coaxial, twin axial and/or twisted pair cables. The invention is especially suited for the termination of shielded cables of the type mentioned, such that controlled impedance is provided through the connector, from mating face to cable end.

A variety of connectors for terminating shielded cables are known in the art. Such connectors are typically designed for a single type of application and are not typically easily altered for use with, for example, different signal/ground configurations, or for use with different types of connection methods, e.g., soldering or welding. In addition, known connectors are typically difficult to assemble, often requiring multiple molding steps, over-molding of electrical contacts and the like, which add time and expense to the connector fabrication process. Finally, prior art connectors often do not provide adequate performance characteristics for high performance systems. Inadequate performance characteristics include, for example, the inability to control the impedance within the connector, or to match the connector impedance with that of the system in which the connector is used. What clearly is needed is a connector which provides greater flexibility in its use and which is easy and economical to produce.

SUMMARY OF THE INVENTION

Accordingly, the invention described herein provides an electrical connector which is easily assembled and configured for alternate uses, and which may be adjusted to provide a controlled impedance across each signal line of the connector.

Briefly, the present invention provides a connector for terminating a shielded cable and connecting the cable to regularly arranged contact pins. The connector comprises a planar connector body formed from an insulative material which has a plurality of longitudinal channels each adapted to receive a socket contacts. A planar conductive ground plate covers the bottom surface of the connector body and extends across each of the plurality of socket contacts. The ground plate makes electrical contact with the shield of the cable to establish a ground plane equidistant from each of the socket contacts. A cover member encloses the socket contacts.

A plurality of the connectors may be stacked together and held in a stacked configuration by a retaining rod which secures to mating engagement surfaces on the connector bodies. In a stack of connectors, the cover member may be provided with a conductive portion which is electrically connected to the ground plate, where the conductive portion of the cover member is formed to extend above the top side of the connector body and make electrical connection with the ground plate of the connector stacked above. In this manner, each of the ground plates in a stack of connectors may be assured of being at the same ground potential.

DETAILED DESCRIPTION OF THE INVENTION

Figure 1:
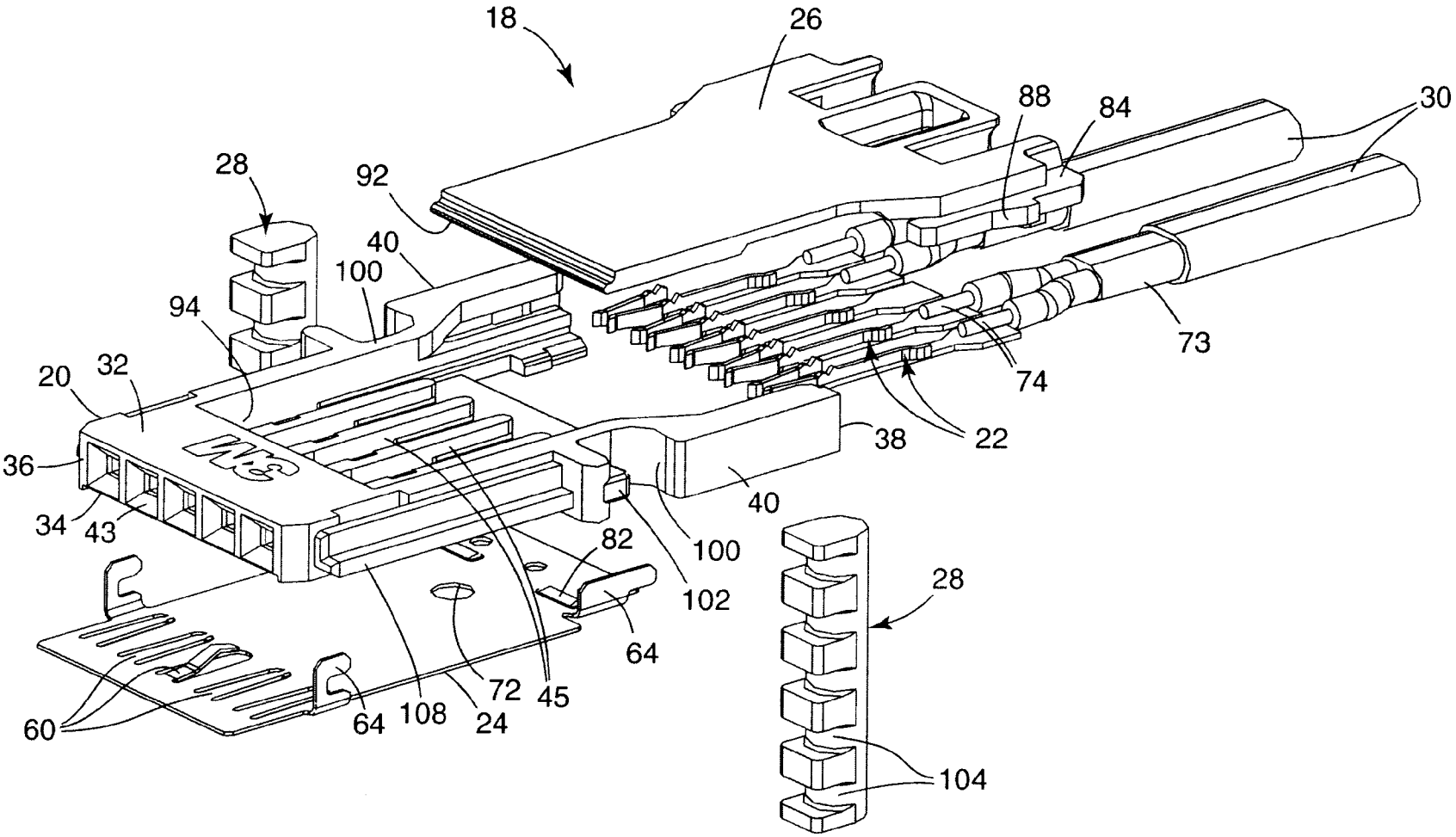
FIG. 1 is an exploded perspective view of one embodiment of the cable connector described herein.

The connector 18 of the present invention, shown in FIG. 1 in an exploded view, includes a connector body 20 formed from an insulative dielectric material, a plurality of socket contacts 22, a planer conductive ground plate 24, and cover member 26. Retention rods 28 may be used when a plurality of connector bodies are stacked together. The connector 18 is shown in FIG. 1 in use with a pair of twin axial cables 30. However, as will be discussed in greater detail below, the connector 18 of the present invention may be used with other types of shielded cables, such as coaxial or twisted pair cables.

Connector body 20 includes a top side 32 and an opposing bottom side 34. The top and bottom sides 32, 34 are defined by a front edge 36, a back edge 38 and two longitudinal side edges 40. Top side 32 of connector body 20 includes a plurality of channels 42 separated by ribs 45 extending from openings 43 in front edge 36 toward back edge 38. The channels 42 are adapted to receive socket contacts 22 and retain socket contacts 22 securely within the connector body 20.

Figure 2:
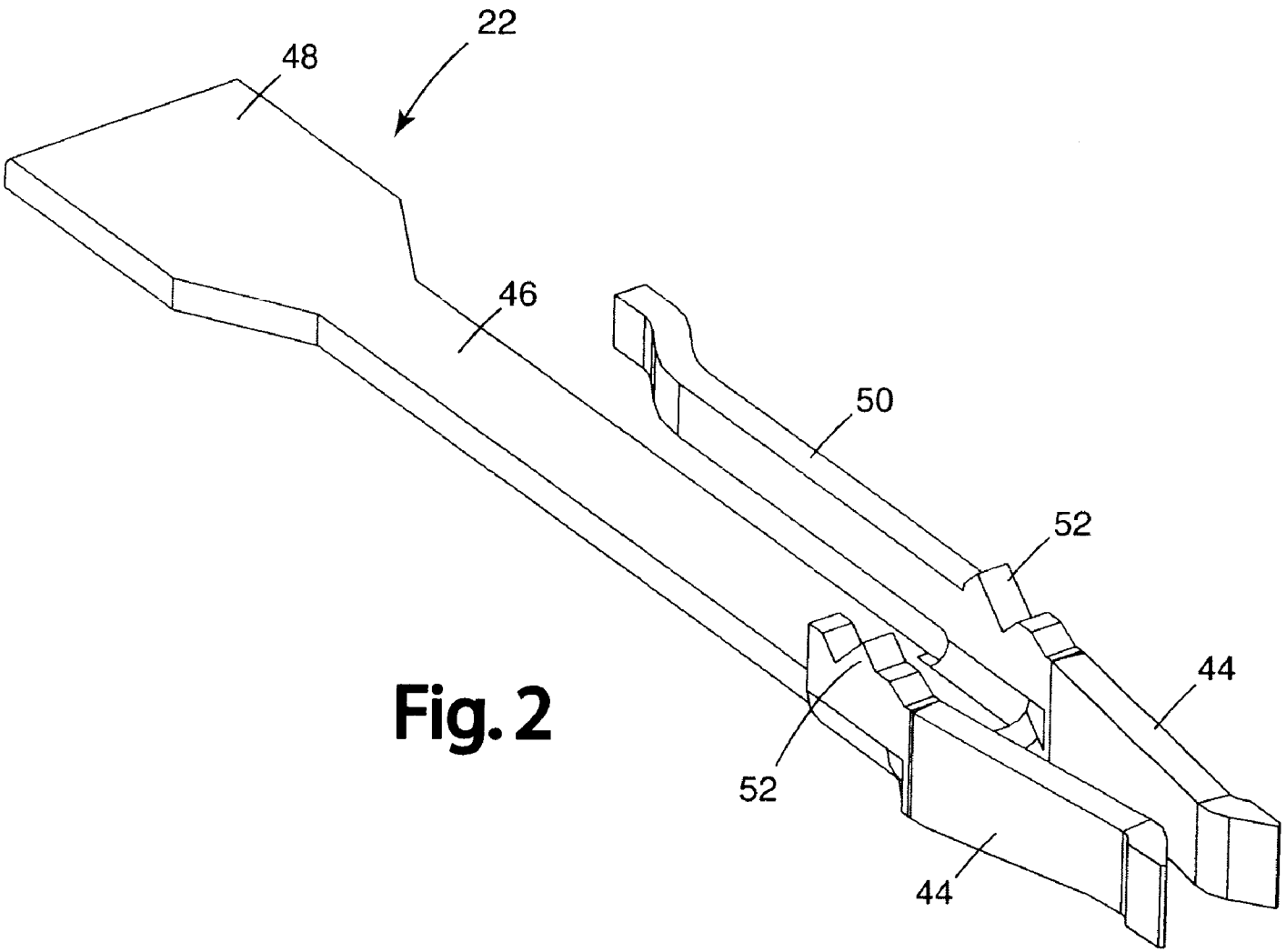
FIG. 2 is an enlarged perspective view of the socket contact used in the connector of FIG. 1.

As best seen in FIG. 2, socket contact 22 includes resilient contact portions 44 which are adapted to engage a corresponding contact pin (not shown) inserted through opening 43 when the connector 18 is in use. Shank 46 extends from resilient contact portions 44 to socket terminal 48. The width and height of shank 46 and terminal 48 may be selected to control the characteristic impedance in a known microstrip relationship with the ground plane provided by ground plate 24 described in greater detail below. The characteristic impedance may also be controlled by altering the thickness of the portion of connector body 20 which is between contacts 22 and ground plate 24, or by altering the dielectric constant of the material of connector body 20.

Socket contact.22 also includes spring member 50 which locates socket contact 22 properly within channel 42, and removably retains contact 22 within its respective channel 42 without damage to the housing, such that an individual socket contact 22 may be replaced without damaging the housing. Although socket contact 22 may be provided with additional contact retention features 52 which are shaped to frictionally engage the connector body 20 and aid in maintaining the position of socket contact 22, such lance or sawtooth features may make replacement of contacts difficult. It is advantageous to have removable socket contacts 22, so that damaged contacts may be replaced at relatively low cost, instead of causing the entire connector 18 to be rendered inoperable.

Figure 3A:
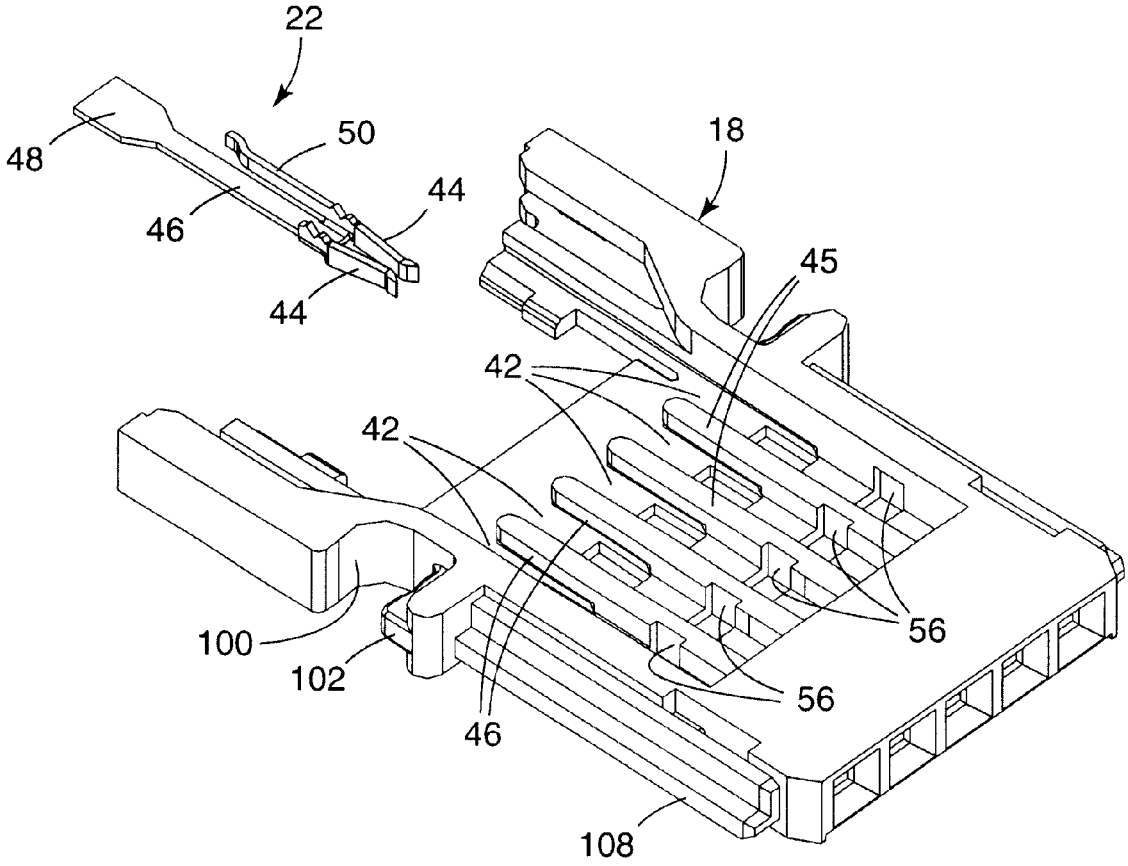
FIGS. 3*a* and 3*b* are perspective views illustrating the insertion of a socket contact into the connector body.
Figure 3B:
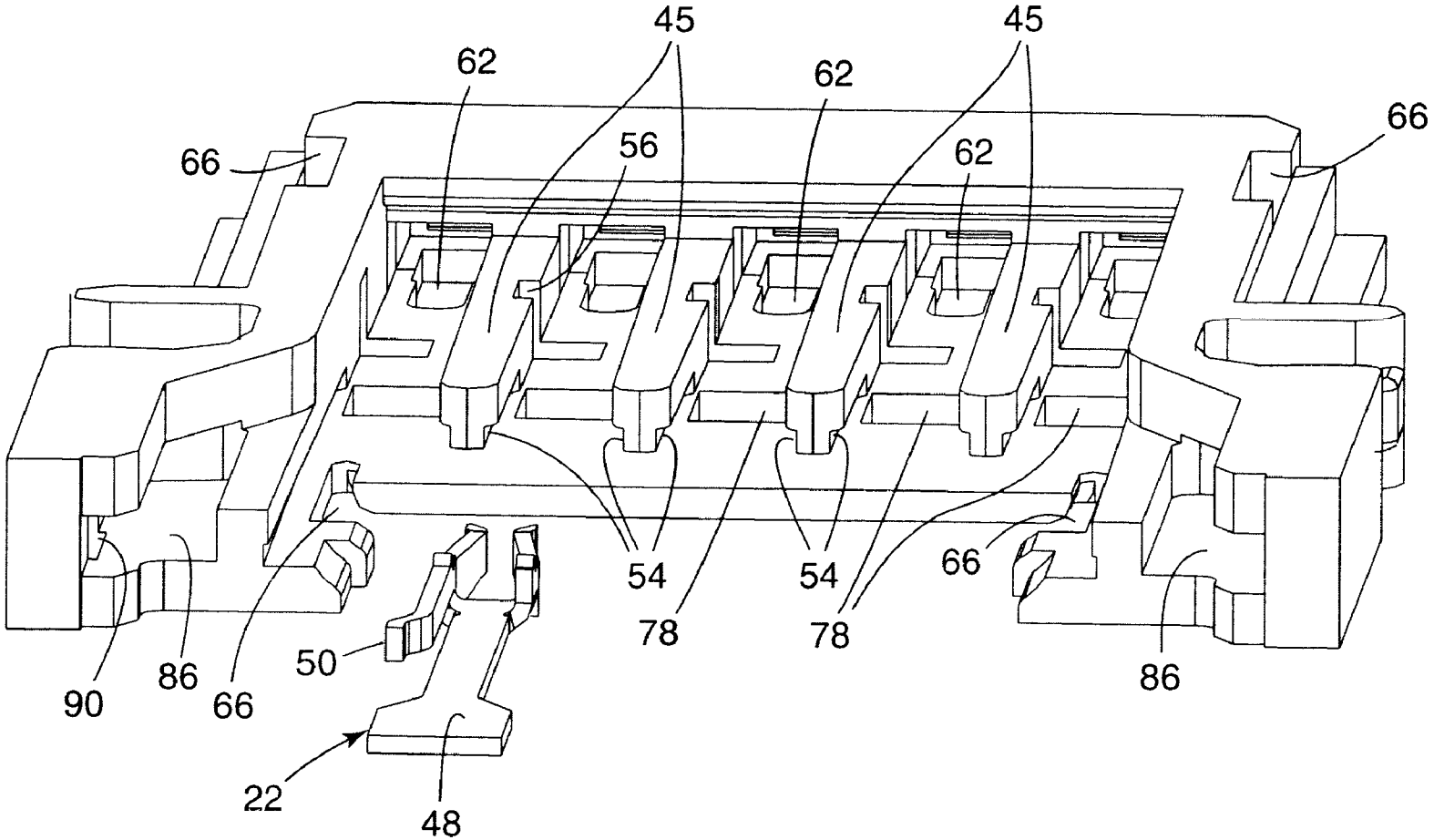

As can best be seen in FIGS. 3*a* and 3*b*, socket contact 22 is adapted to slide longitudinally into a mating channel 42 in connector body 20. As contact 22 slides into position, socket terminal 48 engages recesses 54 in the walls of channel 42. In this manner, socket contact 22 is held securely against the bottom of channel 42, thereby eliminating air gaps between socket contact and connector body 20 which may cause impedance variations across the connector. This is important, as the spring force of the signal conductors 74 of cables 30 may otherwise tend to lift terminals 48 away from connector body 20. As socket contact 22 is moved further toward front edge 36 of connector body 20, spring member 50 snaps into detent 56 in the wall of channel 42. At this point, socket contact 22 is properly located and secured within its channel 42. Socket contact 22 is prevented from moving out of channel 42 by spring member 50 which is engaged with detent 56, and by terminal 48, which is engaged with recesses 54. A contact 22 is placed in each channel 42 in the above-described manner.

After socket contacts 22 are positioned within connector body 20, ground plate 24 may be attached to the bottom side 34 of connector body 20. Ground plate 24 is formed of a conductive material, such as metal. Ground plate 24 includes deformable grounding contacts 60 which may be selectively deformed to ground one or more of socket contacts 22. One or more of the grounding contacts 60 may be deformed so as to ground a socket contact 22. In this manner, connector 18 may be provided with a programmable grounding scheme.

Grounding contacts 60 make mechanical and electrical connection with socket contacts 22 through openings 62 in the bottom side 34 of connector body 20 (best seen in FIG. 3*b*). The grounding contacts 60 may make only spring force contact with socket contacts 22, or they may alternatively be soldered or welded to socket contacts 22.

Figure 4:
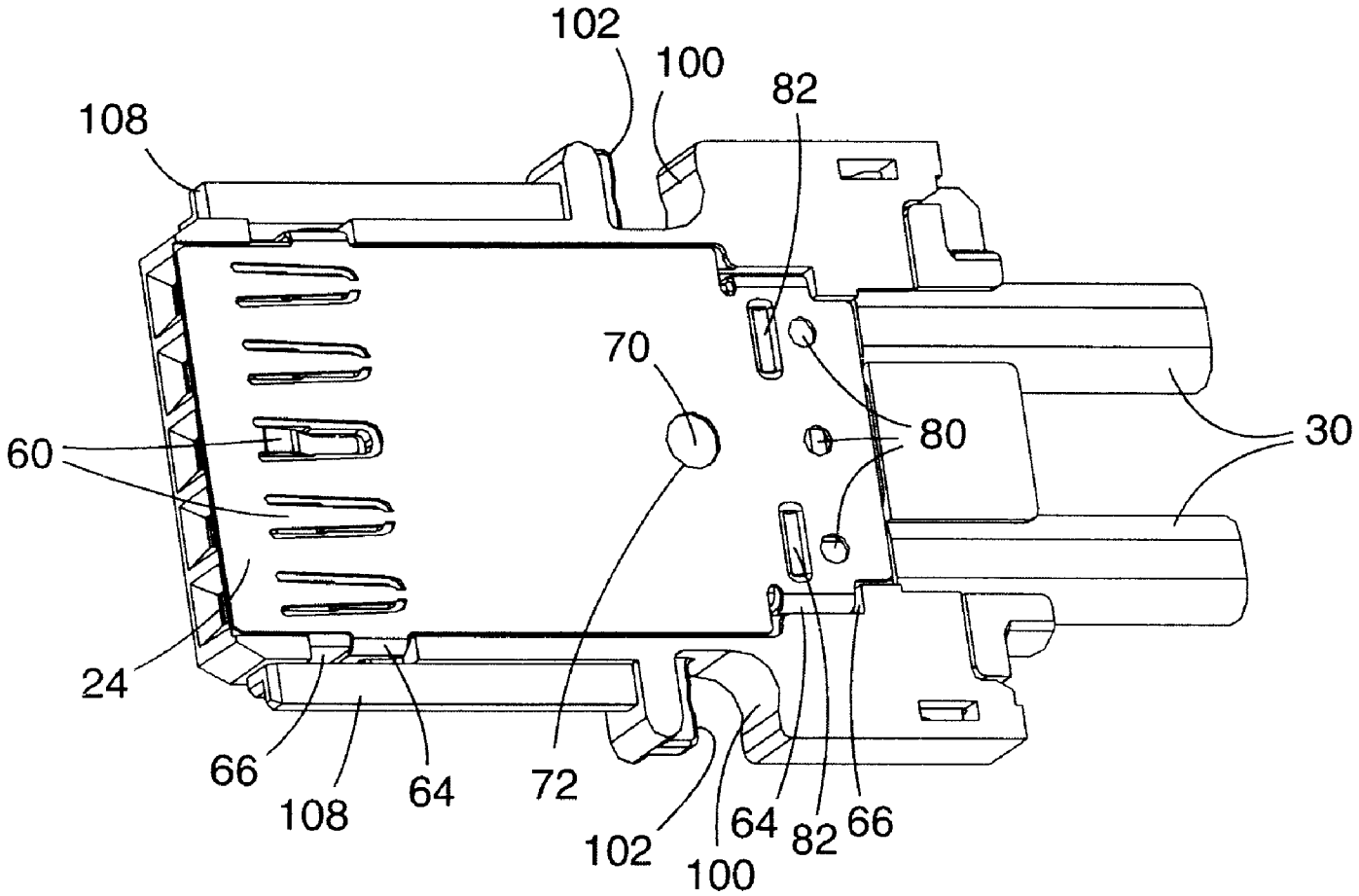
FIG. 4 is a perspective view of the bottom side of the assembled connector of FIG. 1.

Ground plate 24 is secured to the bottom side 34 of connector body 20 by locking tabs 64. Locking tabs 64 engage slots 66 in the bottom side 34 of connector body 20 (FIG. 4). After locking tabs 64 are positioned in slots 66, ground plate 24 is moved toward back edge 38 of connector body 20. This sliding motion causes locking tabs 64 to engage ledges (not shown) in slots 66 and pull grounding plate 24 tightly against the bottom side 34 of connector body 20. Locking tabs 64 are shaped so as to cause a camming action as ground plate 24 is moved toward back edge 38. This camming action urges the ground plate against the connector body 20, thereby eliminating air gaps, which may cause impedance variations across the connector. For this reason, it is preferred that the material of ground plate 24 be somewhat resilient. Beryllium-copper alloy is an example of one suitable material, although other suitable materials will readily be recognized by those skilled in the art. To further assure a tight fit between ground plate 24 and bottom side 34, ground plate 24 is preferably formed so as to have a slightly concave shape when unattached to connector body 20, such that locking tabs 64 tend to pull the edges of ground plate 24 toward bottom side 34 and thereby flatten ground plate 24 against bottom side 34. When ground plate 24 is fully in position, a raised projection 70 on bottom side 34 engages opening 72 in ground plate 24. In this manner, ground plate 24 is prevented from moving toward front edge 36 and possibly becoming disengaged from connector body 20.

The direction in which ground plate 24 is installed onto connector body 20 (i.e., in the direction of axial pullout when connector 18 is engaged) assures ground plate 24 will not be dislodged while disconnecting an engaged connector 18. Specifically, when cables 30 are attached to connector 18, the cable shields 73 are attached to ground plate 24 by soldering or other means such as welding. Because ground plate 24 is installed in the direction of axial pullout force (which is applied to the cable when the connector 18 is disengaged from use), pulling on the cables tends to further secure ground plate 24 to connector body 20, rather than tending to dislodge or loosen ground plate 24.

As can be seen in FIG. 4, ground plate 24 extends across each of socket contacts 22 in the connector. This provides several advantages to the performance of connector 18. Because ground plate 24 is part of the current return path, it is advantageous to provide as wide of a return path as possible to minimize the self-inductance generated in the connector. A long and narrow return path tends to cause greater self-inductance, which is detrimental to the connector performance. It will be noted that the deformable grounding contacts 60 of ground plate 24 are positioned such that the base of the deformed contact 60 is positioned close to front edge 36 of the connector. Because the ground plate 24 becomes part of the current return circuit of the connector, and any difference in the lengths of the signal and ground paths causes increased self-inductance in the connector (and hence an increase in impedance), it is advantageous to position the grounding contacts 60 as close as possible to the engagement point of the mating grounded component, e.g., the ground pin of the mating pin header 106. In an alternate embodiment, the ground contact 60 could be shaped so as to make contact with the ground pin of the mating pin header. In this manner, the lengths of the signal and ground paths are kept as close as possible to the same length, thereby minimizing any self-inductance within the connector.

Finally, by extending ground plate 24 across each of the contacts 22, a ground plane is established across the entire connector which allows the impedance of the connector to be closely controlled at each signal line. By securing ground plate 24 in the manner described above, it is ensured that the spacing between socket contacts 22 and the ground plane created by ground plate 24 is maintained at a constant and uniform distance. Socket contacts 22 form what is referred to as a microstrip geometry with the ground plane. The method for determining the impedance of a device having microstrip geometry is known in the art, and it will be recognized that by maintaining the spacing between the ground plane and socket contacts 22 at a uniform distance, the impedance of connector 18 can be closely controlled and adjusted for optimal connector performance. For example, the impedance can be adjusted by altering the width and thickness of the socket contact, by varying the dielectric constant of the material forming connector body 20, or by altering the thickness of the material between contacts 22 and ground plate 24. If the spacing between socket contacts 22 and the ground plane varies across the width of connector 18, each of socket contacts 22 will experience a different impedance, thus causing degradation of a signal passing through the connector. Such impedance variations limit the bandwidth of the connector and are not acceptable in many high performance systems.

Figure 5:
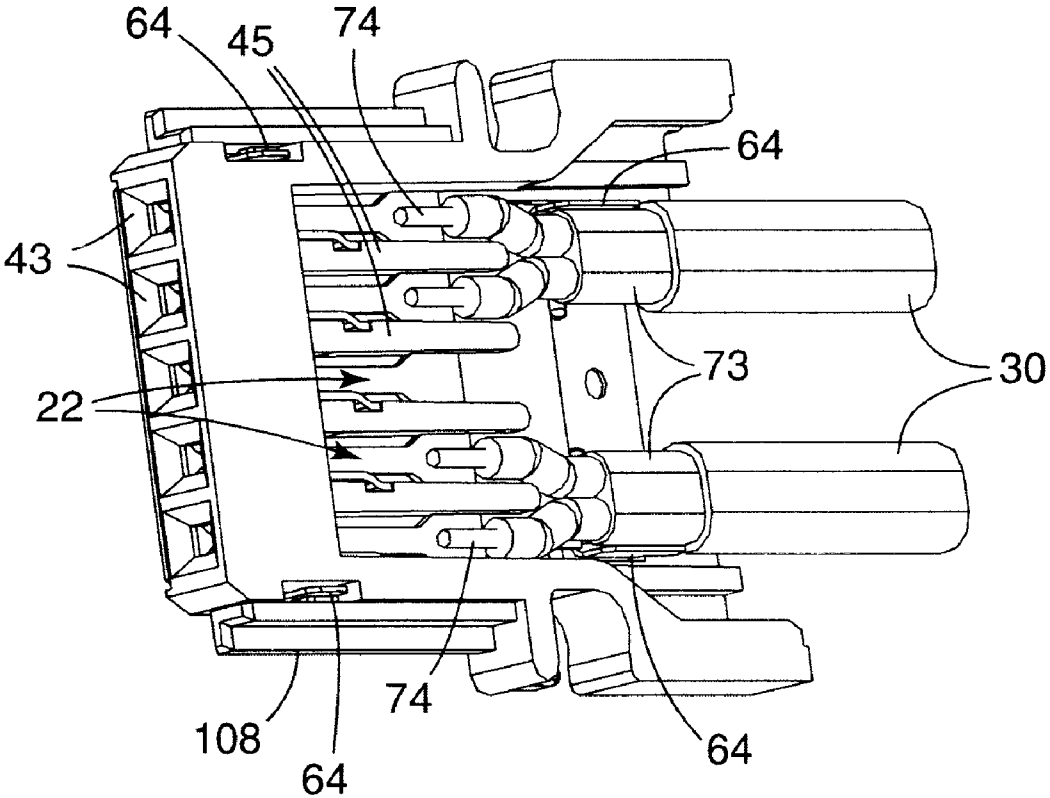
FIG. 5 is a perspective view of the assembled connector without the cover member.

After the ground plate 24 is attached to connector body 20, cables 30 may be attached to the connector 18. The signal conductors 74 of cables 30 are connected to the terminals 48 of the appropriate socket contacts 22, while the cable shields 73 are attached to ground plate 24. This may be seen in FIGS. 4 and 5. In FIG. 5, it can be seen that the locking tab 64 may also function as a solder tab for the connection of cable shield 73. Although the signal conductors 74 of cables 30 will typically be attached to contact terminals 48 by soldering, other methods of connection may be used. For example, it may be desired in some instances to weld the signal conductors 74 to the socket terminals 48. For this reason, connector body 20 is provided with access openings 78 (best seen in FIG. 3*b*). Access openings 78 allow both sides of socket terminal 48 to be reached by electrodes so that the signal conductors 30 may be welded to the terminals 48. Of course, such welding would have to occur prior to installation of ground plate 24, as ground plate 24 covers access openings 78 after ground plate 24 has been installed onto connector body 20. Alternately, access holes could also be provided in ground plate 24 for access to terminals 48. Ground plate 24 also includes several access openings 80 near back edge 38. Access openings 80, for example, allow a solder paste to be used to connect the electrical shields 73 of cables 30 to ground plate 24. Ground plate 24 may also be provided with raised ridges 82 which aid in positioning signal conductor 74 at the proper height for connection to terminals 48.

It will be noted that ribs 45 which separate channels 42 function as cable organizers, helping direct cables 30 into channels 42 and properly position cable signal conductors 74 over terminals 48. As best seen in FIG. 5, ribs 45 extend only so far toward back edge 38 as is necessary to property align signal conductors 74. This allows signal conductors 74 to be more easily routed to any of a variety of contact terminals 48 without requiring significant bending of signal conductors 74.

Figure 6:
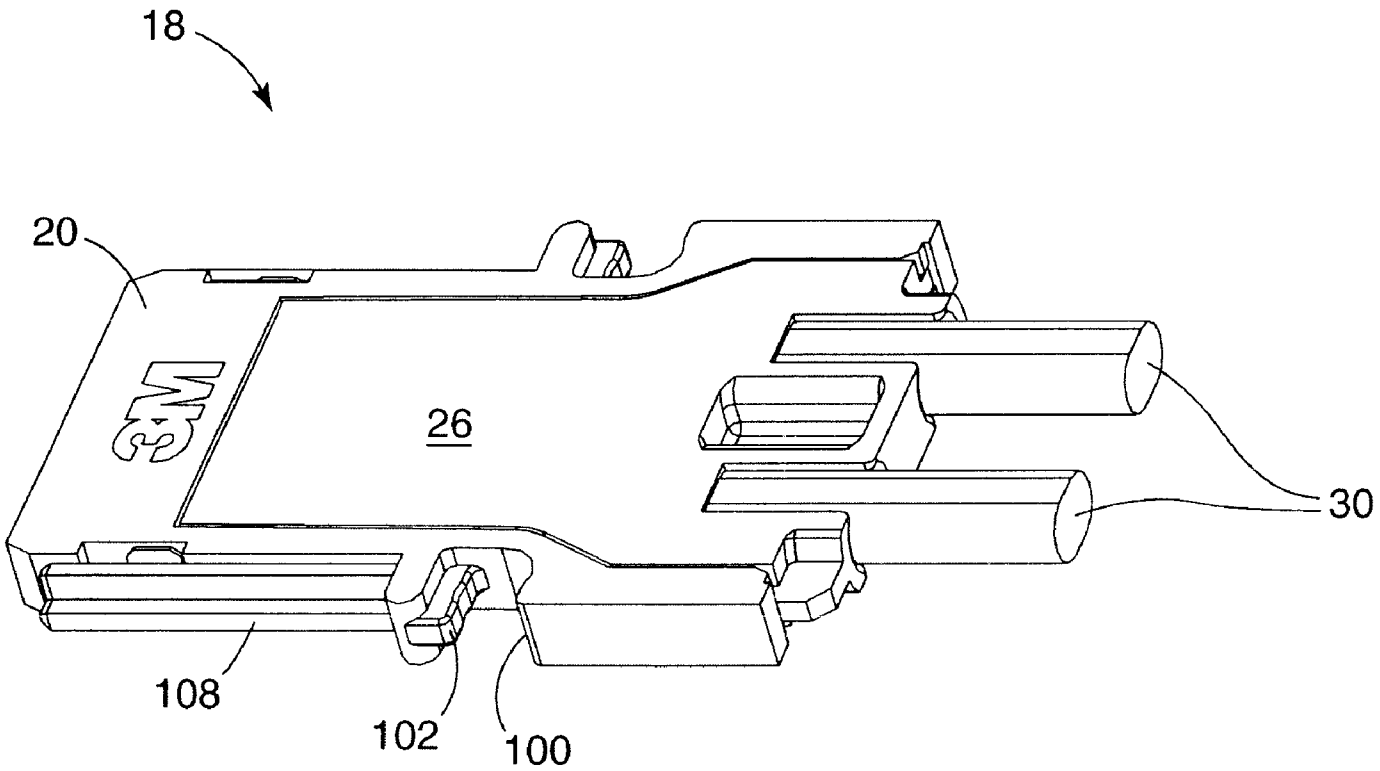
FIG. 6 is a perspective view of the assembled connector with the cover member.

After cables 30 have been secured to contacts 22 and ground plate 24, cover member 26 may be installed to finish assembling connector 18. Cover member 26, as best seen in FIG. 1, is secured to connector body 20 by sliding the cover member 26 from the back edge 38 toward the front edge 36 of the connector body 20. As cover member 26 slides into position, guide rails 84 on cover 26 engage slots 86 in connector body 20 to properly position and secure cover member 26. As cover member 26 becomes fully engaged with connector body 20, latching features 88 on rails 84 securely engage detents 90 within connector body 20, while lip 92 at the front edge of cover member 26 is secured under edge 94 of connector body 20. The assembled connector 18 as thus described and shown in FIG. 6 is then ready for use.

Figure 7A:
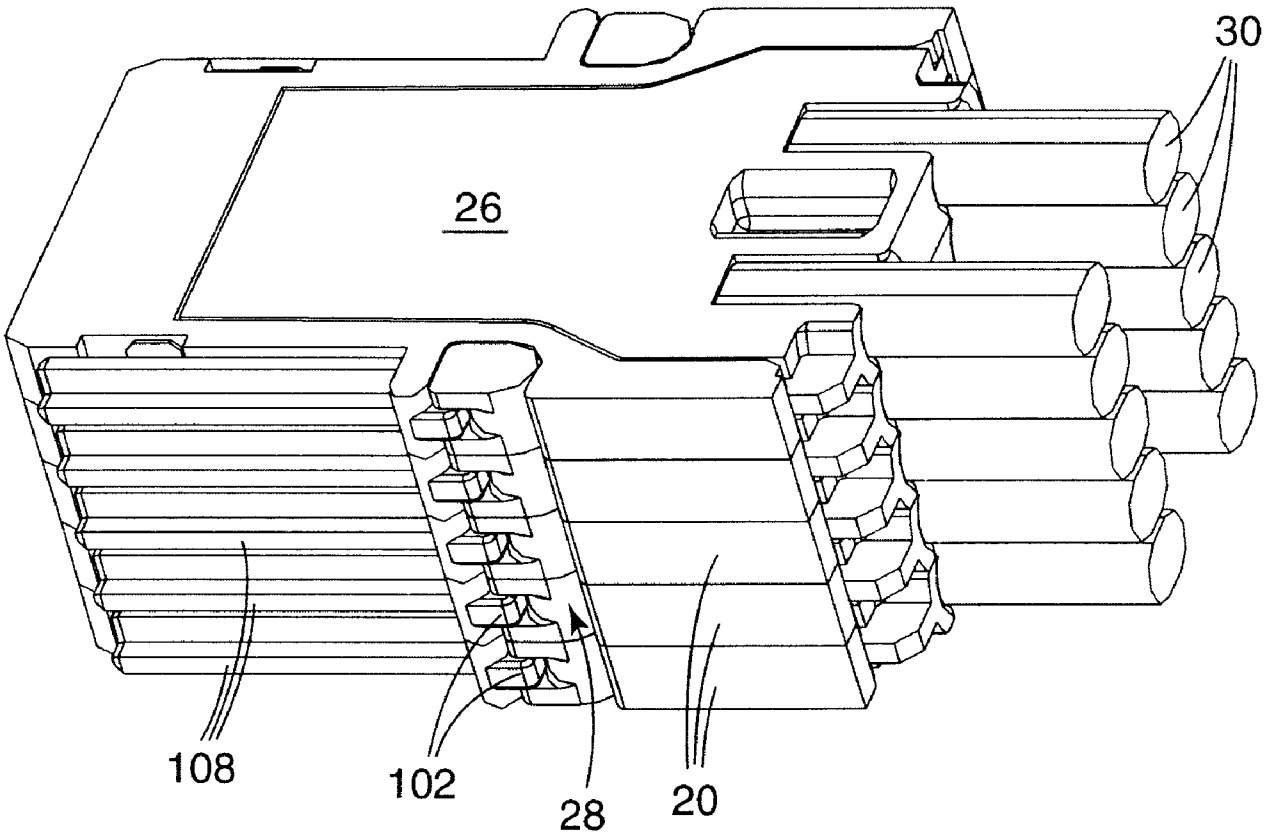
FIGS. 7*a* and 7*b* are perspective views of a stack of assembled connectors.
Figure 7B:
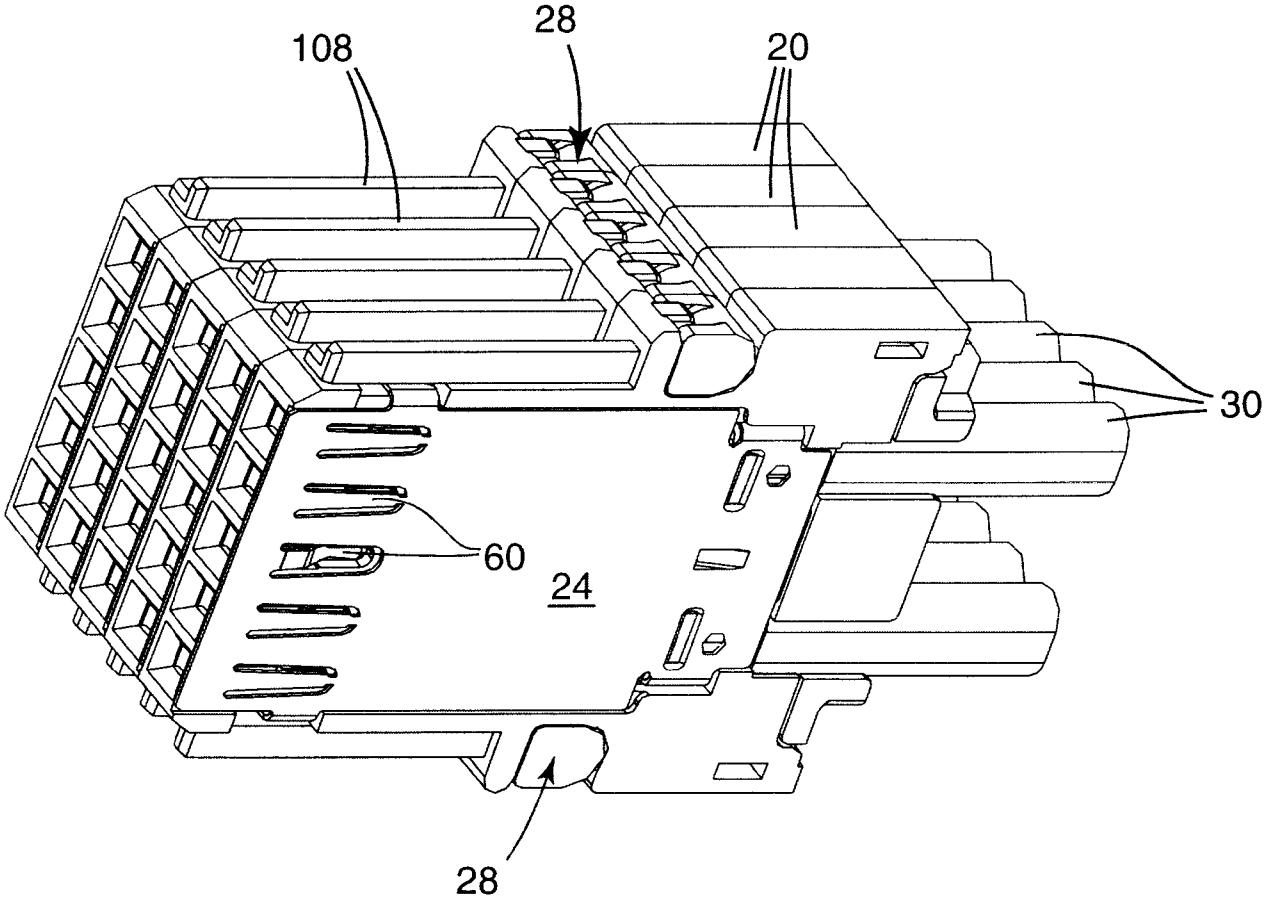

In most applications, a plurality of assembled connectors 18 will be joined together for use as a "stacked" connector. An example of a set of stacked connectors is shown in FIGS. 7*a* and 7*b*. As seen in the Figures, the connectors are secured to each other by retention rod 28. Retention rod 28 is adapted to engage a mating recess 100 on side edges 40 of connector body 20. Recesses 100 include a projecting rib 102 for engaging a mating groove 104 in retention rod 28. The grooves 104 are spaced along retention rod 28 such that when a plurality of connectors 18 are stacked together and secured by retention rod 28, the connectors 18 are held securely against one another. It is preferred that the material of retention rod 28 be somewhat resilient so that retention rod 28 may provide a compression force between the stacked connectors 18. However, the material of retention rod must also be rigid enough to maintain the stacked connectors in proper alignment in all other dimensions.

Retention rod 28 is preferably formed of a polymeric material having a durometer less than the durometer of the material forming connector body 20.

In this manner, retention rod 28 will yield to the material of connector body 20 as retention rod 28 engages connector body 20. Alternately, retention rod 28 is may be formed of a material having a durometer greater than the durometer of the material forming connector body 20, such that the material of connector body 20 yields to the material of retention rod 28.

Figure 8A:
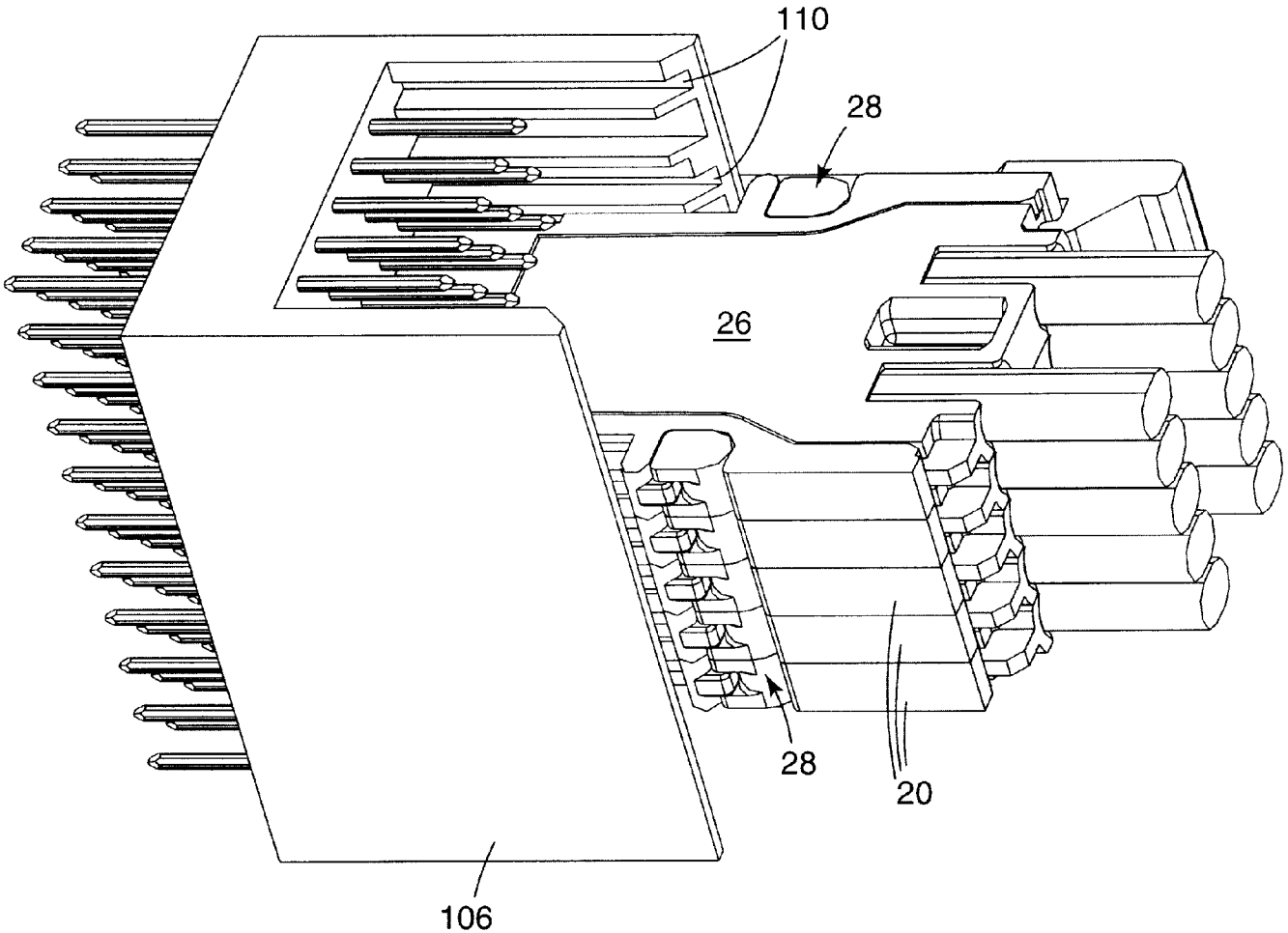
FIGS. 8*a* and 8*b* are perspective views of stacked connectors engaged with a pin header.
Figure 8B:
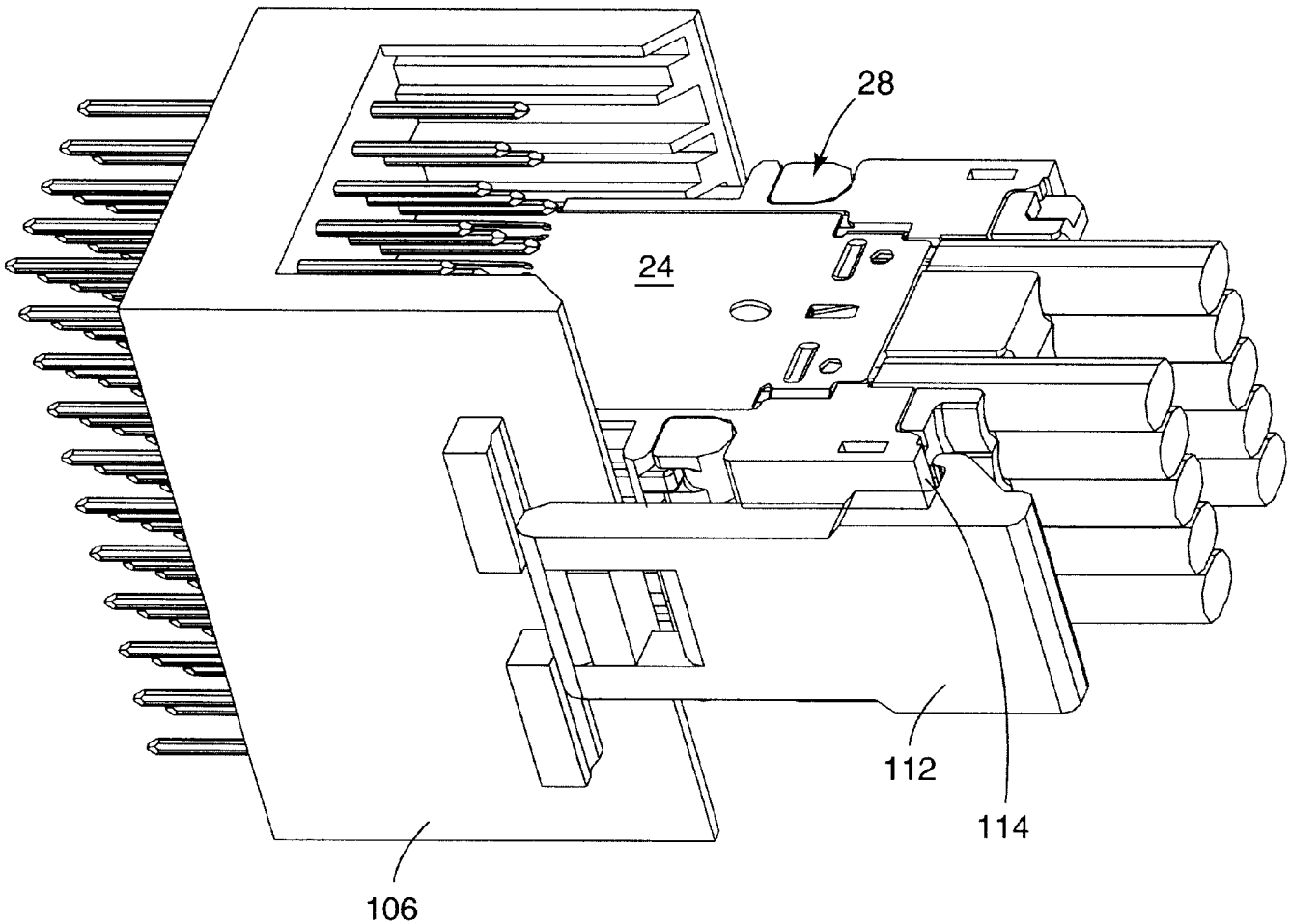

A set of stacked connectors may be engaged with a mating pin header 106, as shown in FIGS. 8*a* and 8*b*. It will be recognized by those skilled in the art that the configuration of retention rods 28 and recesses 100 may be altered to a variety of shapes while still performing their intended function. For example, rather than providing recess 100 in connector body 20 for receiving retention rod 28, a projection (not shown) could extend from connector body 20 and retention rod 28 could be adapted to engage the projection.

The connector 18 and stacking method described herein make it possible to interchange a single connector 18 in a series of stacked connectors without disconnecting the entire stack of connectors from the pin header 106 of a powered system. Commonly referred to as "hot swapping", this may be accomplished by simply removing the retention rods 28 from recesses 100 in the stacked connectors and pulling a single connector 18 from the pin header 106. The removed connector 18 may then be re-inserted after any necessary adjustment is made, or a new connector my be installed in its place. The retention rods 28 are then reinstalled to secure the stack of connectors. This is a significant advantage over prior art stackable connectors which required that the entire stack of connectors 18 be removed from the pin header, and often further required that the entire stack of connectors be disassembled so that a single connector could be replaced. In addition, the manner in which ground plate 24 is installed, as described above, allows a single connector 18 to be removed by pulling on cables 30 without the possibility that ground plate 24 could be dislodged from connector body 20.

To facilitate alignment of connector 18 with the pin field of pin header 106, connector body 20 may be provided with an optional guide rail 108, which is useful for guiding the assembled connector 18 into pin header 106. Guide rail 108 is adapted to mate with grooves 110 in pin header 106. The position and shape of guide rails 108 and grooves 110 may vary depending upon the particular use or application of connector 18. Further, guide rails 108 may function as a connector polarization key to prevent an improper connection with pin header 106.

Other features may be provided to connector 18 and pin header 106. For example, as seen in FIG. 8*b*, pin header 106 may be provided with a retaining latch 112 for securing a stack of connectors 18 within pin header 106. Latch 112 is designed to engage lip 114 at the back edge 38 of connector body 20.

Figure 9:
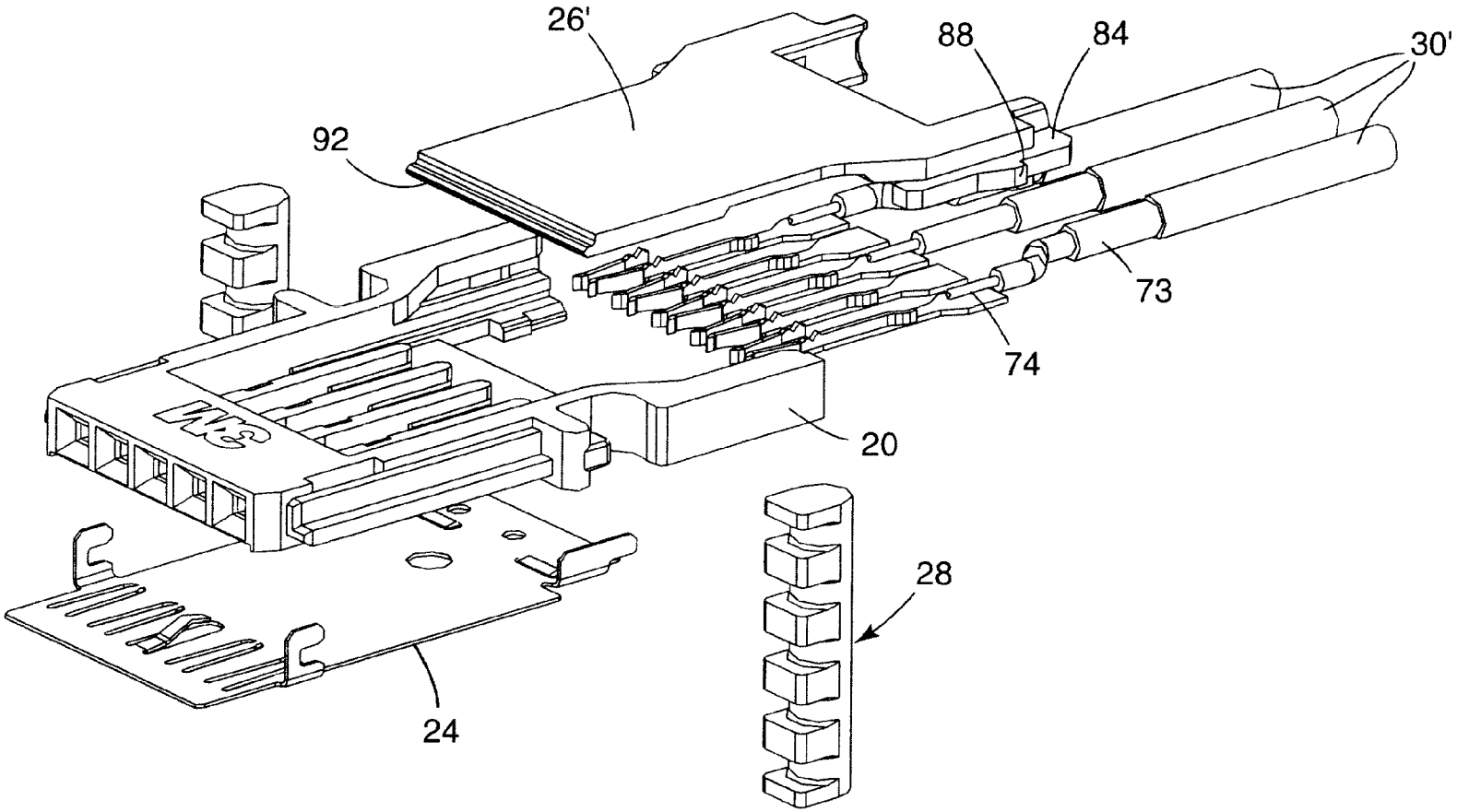
FIG. 9 is an exploded perspective view of the connector showing an alternate embodiment of the cover.
Figure 10:
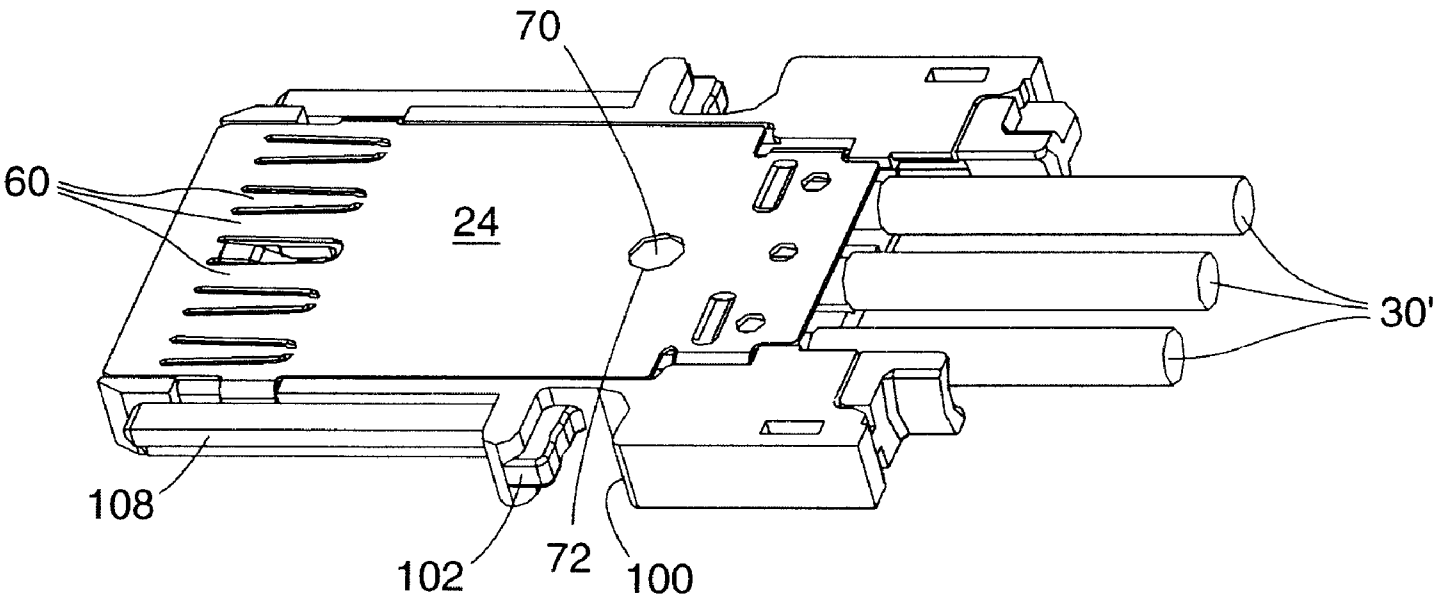
FIG. 10 is a perspective view of the bottom side of the assembled connector of FIG. 9.

Although the connector has been described above for use with two twinaxial type cables, other numbers and types of cables, such as coaxial cables or twisted pair cables may be used with the connector. The identical connector body 20 in ground plate 24 may be used with different types or numbers of cables. However, a slightly modified cover member 26' may be desired for different numbers or types of cables. For example, FIGS. 9 and 10 illustrate use of three coaxial cables 30' with the connector body 20, contacts 22 and ground plate 24 described above. A slightly modified cover member 26' is provided to accommodate the slightly different size and shape of the coaxial cables 30'. However, the guide rails 84, latching mechanism 88 and lip 92 of cover member 26' are identical to that described above for cover member 26.

Figure 11:
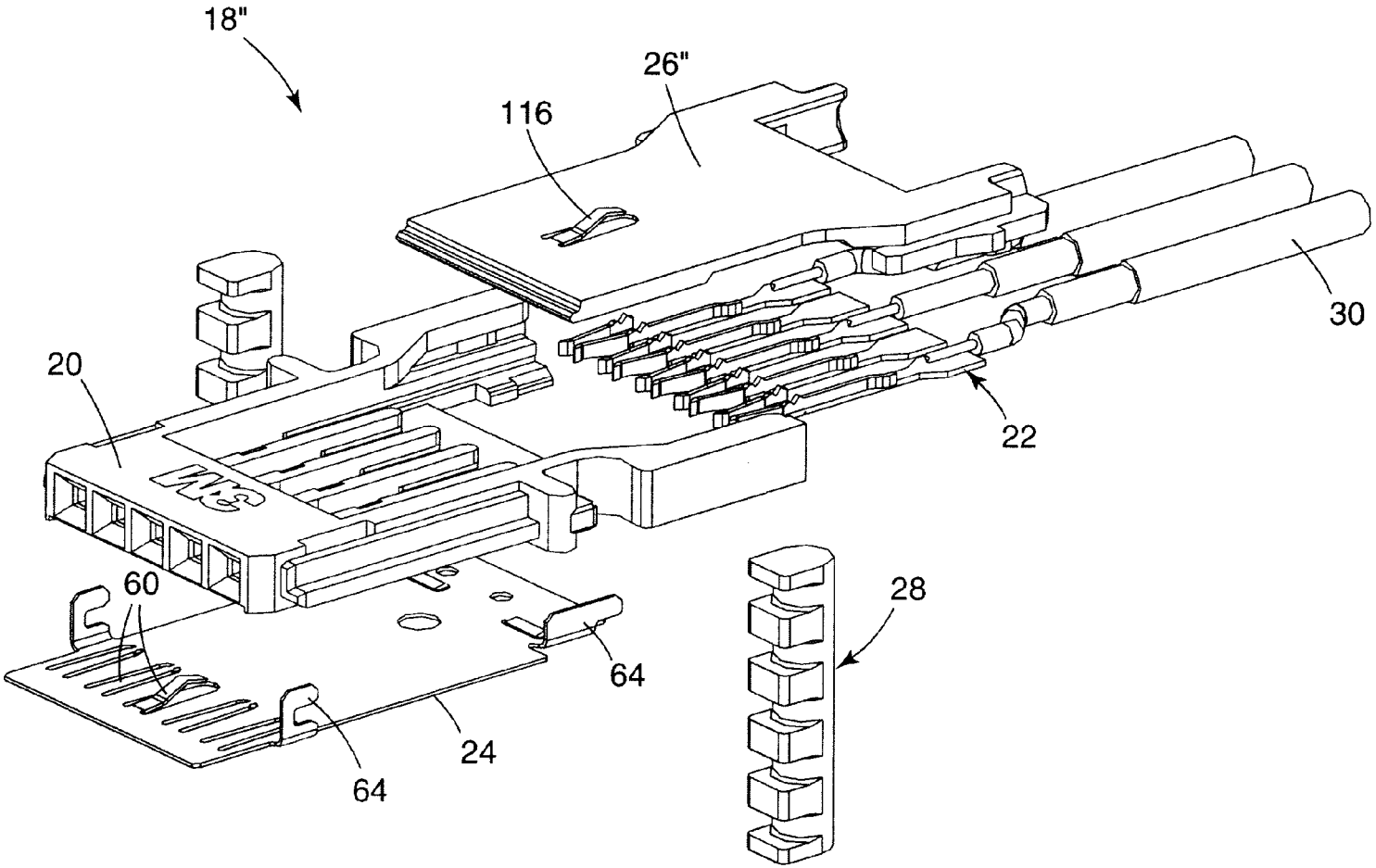
FIG. 11 is an exploded perspective view of the connector showing another alternate embodiment of the cover.

In some instances, it may be desired to form cover 26 from a conductive material or to provide cover 26 with a conductive section, such as by metal plating portions of cover 26, and to then electrically connect the conductive portion of cover 26 to ground plate 24. Such a modified connector 18" and cover 26" are shown in FIG. 11. Cover 26" is provided with a spring contact 116 which will make electrical contact with the ground plate 24 of a connector which is stacked above the cover 26". Cover 26" may make electrical contact with ground plate 24 of the connector 18" by, for example, extending locking tabs 64 of ground plate 24 through connector body 20 to make contact with cover 26". By electrically connecting cover 26" with ground plate 24, the connector 18" is provided with additional shielding and it is possible to assure each individual connector in a stack of connectors 18" is at the same ground potential.

The invention as described above provides numerous advantages compared to prior art connectors. The programmable grounding contacts 60 in ground plate 24 allow complete flexibility as to the arrangement of signal and ground contacts, without requiring design changes to the connector body or cover member. The wide ground plate 24 provides a low impedance current return path, and the uniform spacing between socket contacts 22 and the ground plane created by ground plate 24 allows the connector impedance to be controlled in a known microstrip relationship with the ground plane provided by ground plate 24. The simplified stacking features allow any number of connectors 18 to stacked without extra components, while allowing the stack of connectors 18 to be easily disassembled and further allowing "hot swapping" of a single connector in a stack of connectors.

Although the present invention has been described herein with respect to certain illustrated embodiments, the intention is to cover all modifications, alternative constructions, and equivalents falling within the spirit and scope of the invention.

What is claimed is:

1. An electrical connector for terminating a shielded cable and connecting the cable to regularly arranged contact pins, the connector comprising:

a plurality of socket contacts for mating with a corresponding plurality of contact pins;

a planar connector body formed from an insulative material, the connector body having an upper surface and an opposing lower surface, the upper and lower surfaces defined by a front edge, a back edge and two longitudinal side edges, the upper surface including a plurality of longitudinal channels, each channel containing one of the plurality of socket contacts, the front edge of the connector body having a plurality of openings for guiding the contact pins into the mating socket contacts positioned within the channels;

a planar conductive ground plate engaged with the bottom surface of the connector body, the ground plate extending across each of the plurality of socket contacts to establish a ground plane equidistant from each of the plurality of socket contacts, wherein the ground plate includes at least one grounding tab positioned on the ground plate such that the at least one grounding tab passes through an opening on the bottom surface of the connector body to contact one of the socket contacts; and a cover member mated with the top surface of the connector body and enclosing the longitudinal channels and socket contacts.

2. The electrical connector of claim 1, further comprising a guide rail extending along removably by at least one longitudinal side edge.

3. The electrical connector of claim 1, wherein the cover member further comprises a conductive portion which is electrically connected to the ground plate, and wherein the conductive portion of the cover member is formed to extend above the top side of the connector body.

4. The electrical connector of claim 1, wherein the socket contacts are removably retained within the connector body.

5. The electrical connector of claim 4, wherein the socket contacts each include a spring member for engaging a recess in a wall of their respective channels and thereby retaining the socket contacts in their respective longitudinal channels.

6. The electrical connector of claim 1, further comprising an integrally formed engagement surface on at least one of its longitudinal edges, the engagement surface mated with a retaining rod.

7. The electrical connector of claim 6, further comprising a plurality of electrical connectors forming a stack of electrical connectors, the integral engagement surface of each of said plurality of connectors aligned for engagement with the retaining rod.

8. An electrical connector for terminating a shielded cable and connecting the cable to regularly arranged contact pins, the connector comprising:

a plurality of socket contacts for mating with a corresponding plurality of contact pins;

a planar connector body formed from an insulative material, the connector body having an upper surface and an opposing lower surface, the upper and lower surfaces defined by a front edge, a back edge and two longitudinal side edges, the upper surface including a plurality of longitudinal channels, each channel containing one of the plurality of socket contacts, the front edge of the connector body having a plurality of openings for guiding the contact pins into the socket contacts positioned within the channels;

a planar conductive ground plate adjacent the bottom surface of the connector body, the ground plate extending across each of the plurality of socket contacts to establish a ground plane equidistant from each of the plurality of socket contacts, wherein the ground plate slidably engages the connector body in a front to back direction; and a cover member mated with the top surface of the connector body and enclosing the longitudinal channels and socket contacts.

9. The electrical connector of claim 8, further comprising a guide rail extending along at least one longitudinal side edge.

10. The electrical connector of claim 8, wherein the cover member further comprises a conductive portion which is electrically connected to the ground plate, and wherein the conductive portion of the cover member is formed to extend above the top side of the connector body.

11. The electrical connector of claim 8, wherein the ground plate further comprises at least one locking tab for engaging the connector body, the at least one locking tab having a cammed surface to urge the ground plate against the bottom surface of the connector body.

12. The electrical connector of claim 11, further comprising four locking tabs in the ground plate for engaging the connector body.

13. The electrical connector of claim 4, wherein the at least one locking tab makes electrical contact with the shield of the cable.

14. The electrical connector of claim 8, wherein the socket contacts are removably retained within the connector body.

15. The electrical connector of claim 14, wherein the socket contacts each include a spring member for engaging a recess in a wall of their respective channels and thereby retaining the socket contacts in their respective longitudinal channels.

16. The electrical connector of claim 8, further comprising an integrally formed engagement surface on at least one of its longitudinal edges, the engagement surface adapted to mate with a retaining rod.

17. The electrical connector of claim 16, further comprising a plurality of electrical connectors forming a stack of electrical connectors, the engagement surface of each of said plurality of connectors aligned for engagement with the retaining rod.

18. A stackable connector assembly comprising:

a plurality of planar connector bodies, each connector body having two longitudinal edges, a front edge, and a back edge, each of said plurality of planar connector bodies including a monolithic engagement surface on at least one of its longitudinal edges, each engagement surface positioned such that when the plurality of connector bodies are stacked upon each other the engagement surfaces are aligned with each other; and a retaining rod configured to securely engage each of the engagement surfaces, such that the plurality of planar connector bodies arc secured in a stacked configuration.

19. The connector assembly of claim 18, wherein the retaining rod is formed from a material having a durometer less than the durometer of the connector body.

20. The connector assembly of claim 18, wherein the retaining rod is formed from a material having a durometer greater than the durometer of the connector body.

21. The connector assembly of claim 18, wherein the retaining rod is formed from a polymeric material.

22. The connector assembly of claim 18, wherein the engagement surface comprises a recess having a projecting rib, and wherein the retaining rod includes a groove for mating with the projecting rib.

23. The connector assembly of claim 18, wherein the engagement surface comprises a projecting rib, and wherein the retaining rod includes a groove for mating with the projecting rib.

24. The connector assembly of claim 18, further comprising a planar ground plate on a bottom surface of each connector body and a conductive portion on a top surface of at least one of said plurality of connector bodies, the conductive portion electrically connected to the ground plate of said at least one connector body and protruding above the top surface of said at least one connector body.

25. The connector assembly of claim 24, wherein the conductive portion protrudes above the top surface of said at least one connector body to contact the ground plate of a connector stacked adjacent the top surface of said at least one connector body.

* * * * *

UNITED STATES PATENT AND TRADEMARK OFFICE

CERTIFICATE OF CORRECTION

PATENT NO. : 6,524,135 B1
DATED : February 25, 2003
INVENTOR(S) : Feldman, Steven It is certified that error appears in the above-identified patent and that said Letters Patent is hereby corrected as shown below:

Column 1,
Line 42, delete "receive a socket contacts." and insert in place thereof-receive socket contacts. --

Column 2,
Line 54, delete "contact.22 also" and insert in place thereof -- contact 22 also --

Column 5,
Line 24, delete "property" and insert in place thereof -- properly --
Line 66, delete "retention rod 28 is may be formed" and insert in place thereof -- retention rod 28 may be formed --

Column 7,
Line 26, delete "18 to stacked" and insert in place thereof -- 18 to be stacked --
Line 66, delete "along removably by at least" and insert in place thereof -- along at least --

Column 8,
Line 61, delete "13. The electrical connector of claim 4," and insert in place thereof -- 13. The electrical connector of claim 11, --

Signed and Sealed this

Nineteenth Day of August, 2003

JAMES E. ROGAN
*Director of the United States Patent and Trademark Office*